US005860651A

United States Patent [19]

Fierro

[11] Patent Number: 5,860,651

[45] Date of Patent: Jan. 19, 1999

[54] THREE-DIMENSIONAL CHESSBOARD

[76] Inventor: Jose V. Fierro, 1001 Schuvler St., Endicott, N.Y. 13760

[21] Appl. No.: 813,403

[22] Filed: Mar. 10, 1997

[51] Int. Cl.[6] ..... A63F 3/02

[52] U.S. Cl. ..... 273/241; 273/261

[58] Field of Search ..... 273/241, 239, 273/260, 261

[56] References Cited

U.S. PATENT DOCUMENTS

| | | | |
|---|---|---|---|
| 3,341,205 | 9/1967 | Dykes | 273/261 |
| 3,604,709 | 9/1971 | Svetz | 273/241 |
| 3,888,487 | 6/1975 | Replogle | 273/241 |
| 4,009,882 | 3/1977 | Rader | 273/241 X |
| 4,129,303 | 12/1978 | Flagg | 273/241 |
| 4,437,667 | 3/1984 | Miller | 273/241 X |
| 5,037,105 | 8/1991 | Klein | 273/241 |

FOREIGN PATENT DOCUMENTS

| | | | |
|---|---|---|---|
| 2174309 | 11/1986 | United Kingdom | 273/241 |

*Primary Examiner*—William E. Stoll
*Attorney, Agent, or Firm*—Salzman & Levy

[57] ABSTRACT

The present invention features a three-dimensional chessboard. This three-dimensional chessboard features a cube with chess game patterns shown on its faces. An arbitrary number of chess pieces may be held onto the exterior surface, or faces of the cube, by mechanical supports, temporary adhesives, Velcro®, gravity, magnetism and elastic forces. The inventive cube is rotatable about an axis that intersects it through one corner of the cube and extends to the opposite, diagonal corner of the cube. The cube can be suspended by hanging one end of it to a cord, which may be tied to any overhead support. Supporting the cube in this fashion lends the board an artistic appearance, and allows a user to see, at almost any rotational position, fifty percent of the board. The three-dimensional board may also be supported upon one corner by a support base. Finally, the chessboard and game pieces can be the subject of a computer program that allows one or more players to manipulate images of the game pieces relative to the image of the chessboard.

5 Claims, 9 Drawing Sheets

THREE-DIMENSIONAL CHESSBOARD

FIELD OF THE INVENTION

This invention pertains to games and, more particularly, to a chess-game apparatus featuring a three-dimensional chessboard.

BACKGROUND OF THE INVENTION

Chess is a popular board game of antique origins. Throughout the ages, people have undertaken to perfect and refine the game. While new strategies and moves are always being invented, so, too, are attempts to add variations to the game's physical aspects and apparatus thereof. Several attempts have been made recently to provide a new, or a modified, chess set. One such endeavor includes a flat, hexagonal chessboard designed for three players, as is described and illustrated in U.S. Pat. No. 3,341,205 (issued on Sep. 12, 1967).

Another variation of a chess game is illustrated in U.S. Pat. No. 3,359,003 (issued on Dec. 19, 1967), in which two, three-dimensional chess- and checkers game boards are illustrated. The chess- and checkerboards are mounted on a globe and a cylinder. The globe and the cylinder have their own, respective supports, as well as the means to hold the pieces in place upon the boards.

In still another variation of a checkerboard game, a three-dimensional board-game apparatus is illustrated in U.S. Pat. No. 3,604,709 (issued on Sep. 14, 1971). In this invention, a cubical form, supported from the bottom side, uses five, checkerboard-like cubical faces.

The present invention provides a new, three-dimensional chessboard enabling a wide variety of opportunities for creating new chess games, as well as for developing and enhancing both visual and mental abilities. The three-dimensional game can also be represented in a computer program in which data representing the board and game pieces can be stored and in which a display can be used by one or more players who manipulate the game pieces displayed, relative to the displayed board.

It is an object of the present invention to provide an improved, three-dimensional chess game.

It is another object of this invention to provide a three-dimensional chess game having aesthetic appeal.

It is a further object of this invention to provide a three-dimensional chess game that has new rules.

DISCUSSION OF RELATED ART

A word-game apparatus with a structure that is similar to the present invention is illustrated in U.S. Pat. No. 4,009,882 (issued on Mar. 1, 1977). This invention depicts a rotating cube that is supported on one edge thereof by a pin-and-hole assembly.

SUMMARY OF THE INVENTION

In accordance with the present invention, there is provided a three-dimensional chessboard with chess pieces. This three-dimensional chessboard features a cube with chess game patterns shown on its faces thereof. An arbitrary number of chess pieces may be held onto the exterior surface, or faces of the cube, by mechanical supports, temporary adhesives, Velcro®, gravity, magnetism and elastic forces. The inventive cube is rotatable about an axis that intersects it through one corner thereof and extends to the opposite, diagonal corner thereof. The cube can be suspended by fastening one end of it to a cord or wire, which may be tied to any overhead support. Suspending the cube in this fashion lends the board an artistic appearance, as well as allows a user to see, at most rotational positions thereof, fifty percent of the board. The three-dimensional board may also be supported upon one corner thereof by a support base. Supporting the cube on a base allows the control of a maximum number of cube rotations in a single direction. The three-dimensional board can also be fabricated as a hollow cube, so that the game pieces and other accessories may be stored inside. In another embodiment of the invention, the three-dimensional, cubical chessboard can be fabricated in a flat version. This flat version consists of both front and back, hexagonal views of the cubical board.

In another embodiment of the inventive chessboard, there are provided adjacent chess squares of the same color, along four edges of the cubical chessboard. This feature has the advantage of allowing chess bishops to occupy any square on the board, which is contrary to the present rules of chess.

Finally, the entire board and game pieces can be reduced to an interactive computer program, by which 3-D graphic images can be displayed on a 2-D display monitor.

BRIEF DESCRIPTION OF THE DRAWINGS

A complete understanding of the present invention may be obtained by reference to the accompanying drawings, when considered in conjunction with the subsequent, detailed description, in which.

DESCRIPTION OF THE PREFERRED EMBODIMENT

Generally speaking, the invention presents a three-dimensional, chessboard game, along with variations thereof. The game as presented has many unique apparatus features and rules, heretofore unknown in the chess game art. The game is designed to illustrate the aesthetic appeal of the game, as well as of the operative features thereof.

Figure 1:
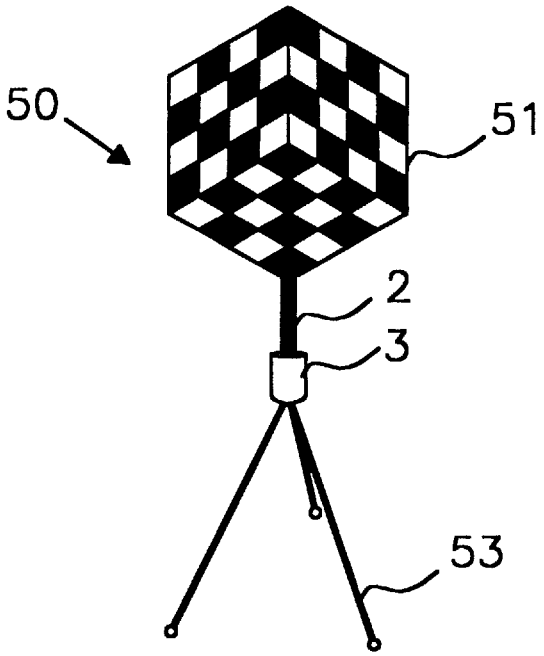
FIG. 1 illustrates a perspective, front view of a cubical chessboard that is fabricated in accordance with the present invention, one that is supported on a tripod base.
Figure 2:
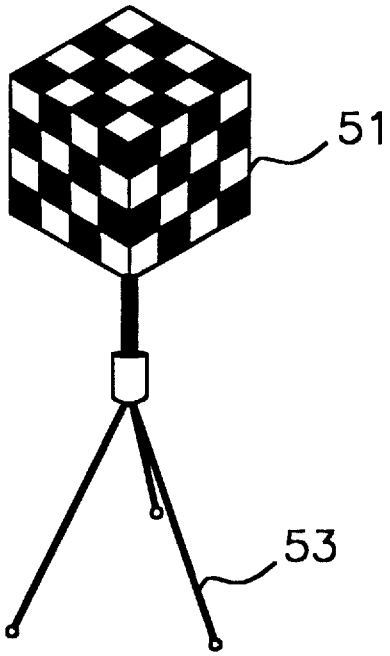
FIG. 2 depicts a perspective, back view of the cubical chessboard shown in FIG. 1.

Now referring to FIGS. 1 and 2, a cubical chessboard assembly 50 is shown. FIG. 1 illustrates one-half of the chessboard 51; FIG. 2 depicts the other half of the chessboard 51, as seen from a back-view. The chessboard 51 is laid out on a cube frame 51, supported by both a tripod 53 that supports a height adjustment screw 2, and a base 3 that supports the screw 2. The base 3 is positioned at the top of the tripod 53, as shown. The chessboard cube 51 can be rotated with respect to screw 2. As the cube 51 is rotated around the vertical symmetry axis, the screw 2 moves in or out of the cube (not shown), thus adjusting the height of the cube 51 with respect to the base 3. The screw adjustment is explained hereinafter and shown in detail, with respect to FIG. 5.

Figure 3:
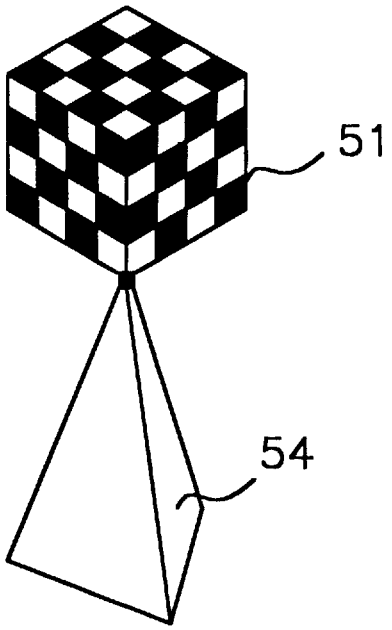
FIG. 3 shows a perspective view of the cubical chessboard depicted in FIG. 2, one that is supported on a pyramidal base.

Referring to FIG. 3, the cube 51 is shown supported on a pyramidal base 54. This base may take the form of any geometric shape. The cube 51 can be rotatively anchored to the base by the screw 2 or, alternatively, with a smooth pin (not shown). In the case of the latter, the cube 51 can rotate about the pin with no vertical height adjustment necessary.

Figure 4:
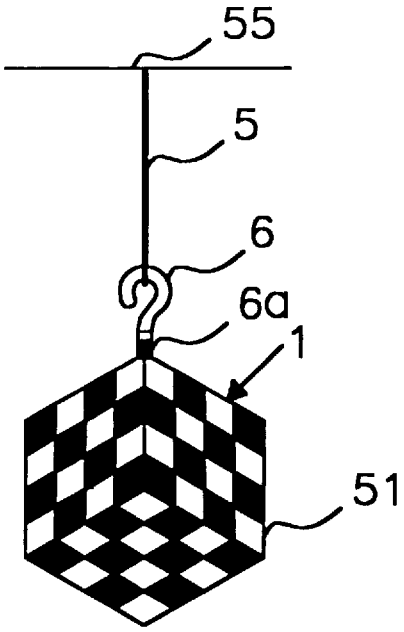
FIG. 4 illustrates a perspective view of the cubical, three-dimensional chess game of this invention, being supported at one corner thereof by a cord suspended from a ceiling support.

Referring to FIG. 4, the cube 51 is shown suspended or hanging from an overhead ceiling support 55 by a threaded hook 6, which is attached to a cord 5 that is affixed to the ceiling 55. In this case, the cube's height can be adjusted by rotating the cube 51 about the threaded portion 6*a* of hook 6.

Figure 5:
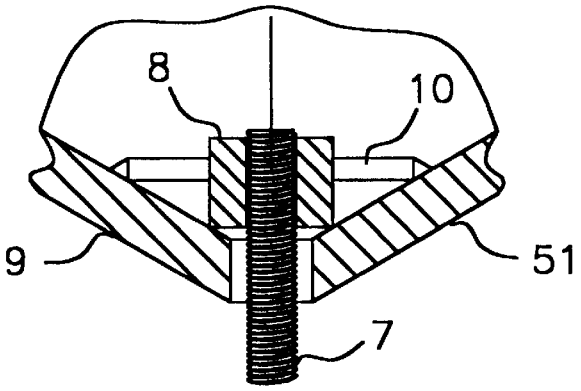
FIG. 5 depicts an enlarged, internal, cutaway view of the cube illustrated in FIG. 1, one that features a nut-and-screw assembly for attaching it to a tripod.

FIG. 5 shows a cutaway view of the nut-and-screw assembly for adjusting the height of the cube 51 on the tripod 53 (FIG. 2) or the pyramid base 54 (FIG. 3). The screw 7 is rotatable within the nut 8. The side walls 9 of the cube 51 are affixed to the nut 8 by connecting arms 10. The nut 8 will rotate upon the screw 7 when the cube 51 is made to turn about the screw 7, thus adjusting the height of the cube 51 about its base support, 53 or 54.

Figure 6:
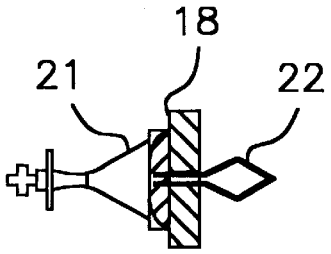
FIG. 6 shows a sectional view of a game piece that is held to a game board with an elastic spring.
Figure 7:
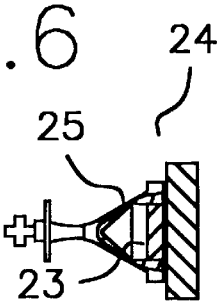
FIG. 7 illustrates a sectional view of a game piece that is held to a game board with a magnet.
Figure 8:
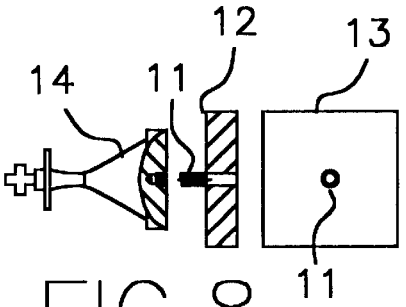
FIG. 8 depicts a sectional view of a game piece that is held to a game board with a screw-and-nut assembly.
Figure 9:
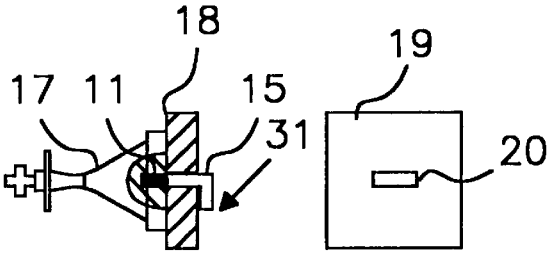
FIG. 9 shows a sectional view of a game piece that is held to a game board with a hook-and-slot assembly.

Referring to FIGS. 6 through 9, various apparatuses are shown for attaching game pieces to the surface of the game board. FIG. 6 illustrates a spring 22 attached to the game piece 21 and the chessboard 18. The game piece 21 is inserted into the spring 22, thus holding the piece 21 to a chosen chessboard square of the chessboard 18. FIG. 7 depicts a game piece 25 being held to a magnetic board 24 by means of an internally disposed magnet 23. FIG. 8 shows a game piece 14 being held to a board 12 that has a threaded pin 11 disposed in each square 13 thereof. The game piece 14 is attached to a particular square by screwing it on one of the threaded pins 11 that corresponds to a particular square 13. Game pieces can also be held to a board that has a threaded hole in each board square, with a threaded pin in the base of each game piece (not shown). FIG. 9 shows a game piece 17 attached to a board 18 that has L-shaped pins 15 disposed in slots 20 of each square 19 of the game board 18. The L-shape of the pins 15 prevents them from pulling out of the board 18. A distal end of the pin 15 contains a screw thread 11 upon which the game piece 17 can be attached.

Figure 10A:
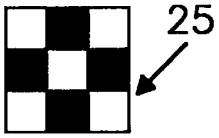
FIGS. 10*a* through 10*k* illustrate a plan view of a selection of chessboard patterns, in accordance with the three-dimensional chessboard of this invention.
Figure 10B:
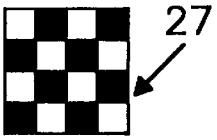
Figure 10C:
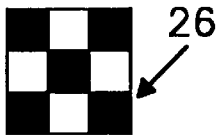
Figure 10D:
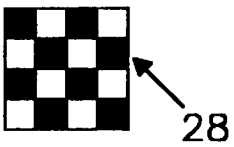
Figure 10E:
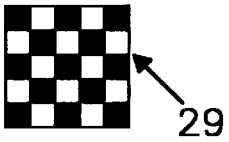
Figure 10F:
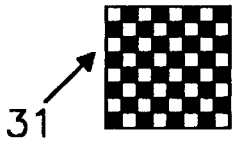
Figure 10G:
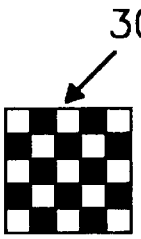
Figure 10H:
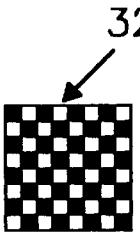
Figure 10I:
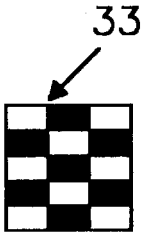
Figure 10J:
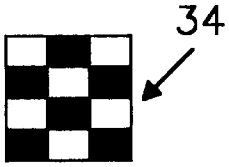
Figure 10K:
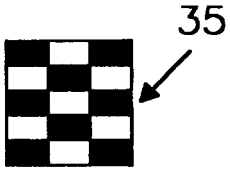

Referring to FIGS. 10*a* through 10*k*, six different chessboard patterns that can be used on the cubical chessboard 51 are illustrated. Other patterns can be added to the cubical, chessboard faces and temporarily held to the cube with screws or magnets. In fact, each additional cubic face can be printed on magnetic sheets and added to a magnetically constructed cube, in order to provide a wide variety of cubic chess patterns. The 3×3 pattern shown by arrows 25 and 26 (FIGS. 10*a* and 10*c*) provides a simplified version of a chess set game having 54 squares. The 4×4 pattern shown by arrows 27 and 28 (FIGS. 10*b* and 10*d*) provides the main version of a cubical chess game having 96 squares. The 5×5 pattern shown by arrows 29 and 30 (FIGS. 10*e* and 10*g*) provides an amplified board version of a cubical chess game having 150 squares. The 8×8 pattern shown by arrows 31 and 32 of FIGS. 10*f* and 10*h* provides an amplified version of a cubical chess game having 64 squares on each face. This embodiment is intended as a multiple, classical chess set, enabling the playing of up to six classical chess games simultaneously by the same two players. The rectangular patterns shown by arrows 33, 34 and 35 (FIGS. 10*i*–10*k*) provide additional examples of means to vary the chessboard pattern. Not only are the chess pattern spaces not limited to squares, but the number of spaces (rectangles in these FIGURES) need not be equal vertically and horizontally (N×N). They may be any integers, N×M.

Figure 11:
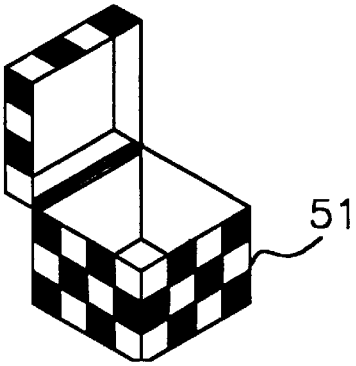
FIG. 11 depicts a perspective view of the cubical chessboard illustrated in FIG. 1, one that is configured as an open box having a hinged cover.
Figure 12:
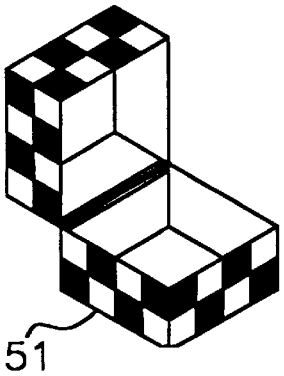
FIG. 12 illustrates a first, alternative embodiment of the invention, viz., a perspective view of the open box and hinged cover depicted in FIG. 11.
Figure 13:
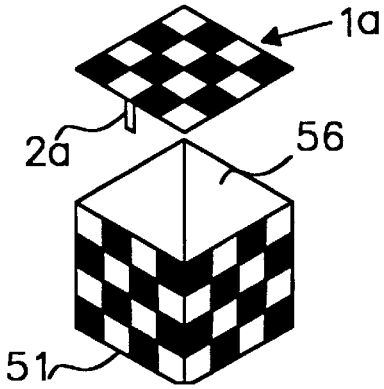
FIG. 13 shows a second, alternative embodiment of the invention, viz., a perspective view of the open box shown in both FIGS. 11 and 12, a box featuring a flat cover-plate.
Figure 14:
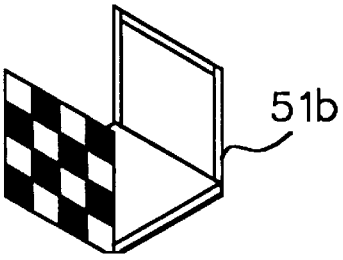
FIGS. 14 and 15 depict a third, alternative embodiment of the invention, viz., a perspective view of respective, mating halves of the box configuration illustrated in FIG. 11.
Figure 15:
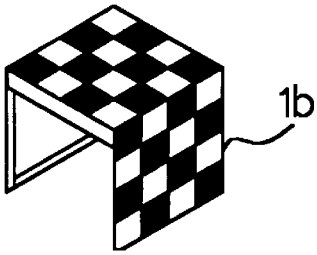
Figure 16:
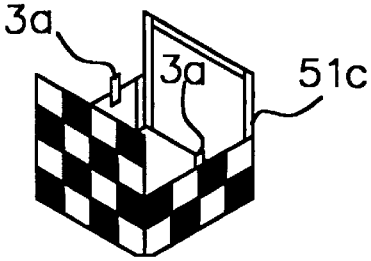
FIGS. 16 and 17 show a second, alternative embodiment of the perspective view of the respective, mating halves of the box configuration depicted in both FIGS. 14 and 15.
Figure 17:
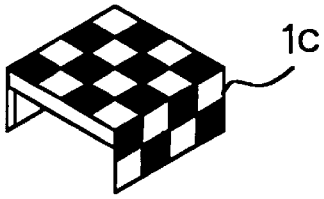

Referring to FIGS. 11 through 17, a variety of different chess cube constructions is shown. In FIGS. 11 and 12, the cube 51 is hinged at different sections of the cube configuration, as illustrated. In FIG. 13, one face, a lid 1*a*, is attached to a cube 51 that is open on one side 56 thereof. The lid 1*a* can comprise spring-loaded tabs 2*a* (with only one, typical tab shown here), in order to hold the lid 1*a* in place about the open side 56 of cube 51. FIGS. 15 and 17 show guided covers 1*b* and 1*c*, respectively, that slide into the partial cube bodies 51*b* and 51*c*, respectively, shown in FIGS. 14 and 16. Grooves or tabs 3*a* can be used to hold the covers in place, on the bias, upon the bodies of the cube, as shown in FIG. 16.

Figure 18:
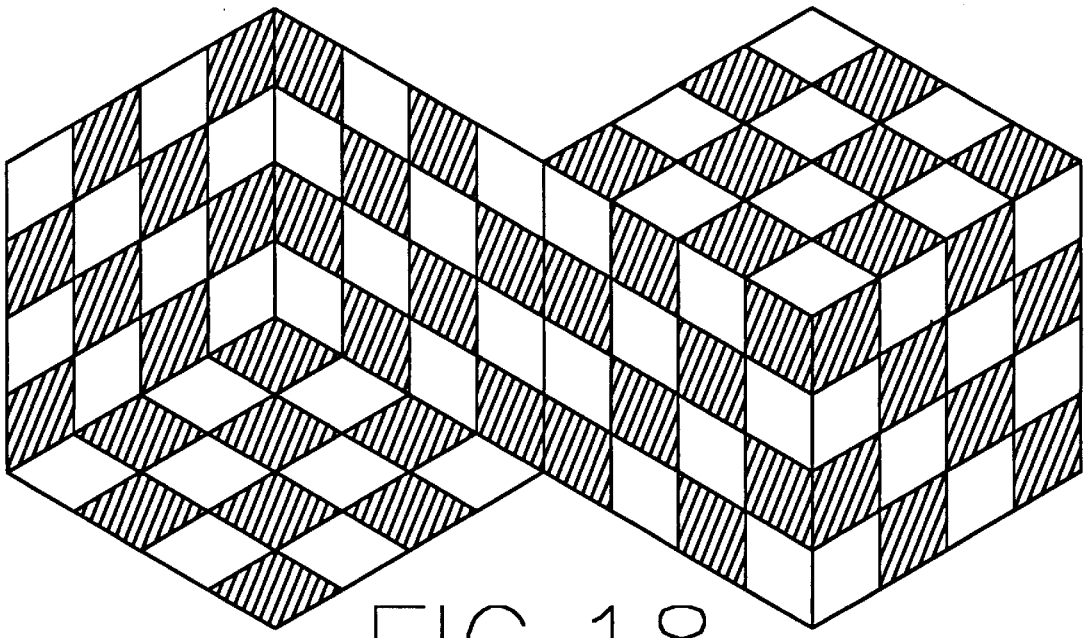
FIG. 18 illustrates a plan view of a two-dimensional, flat layout of the chessboard cube shown in FIG. 1.

Referring to FIG. 18, a two-dimensional version of the chess game is illustrated. In particular, the 4×4 cube face pattern previously shown in FIGS. 10*b* and 10*d* is useful for recording the location of the pieces in a particular position during a chess game. The two-dimensional version is intended to be used to complement a written description of the games.

Figure 19:
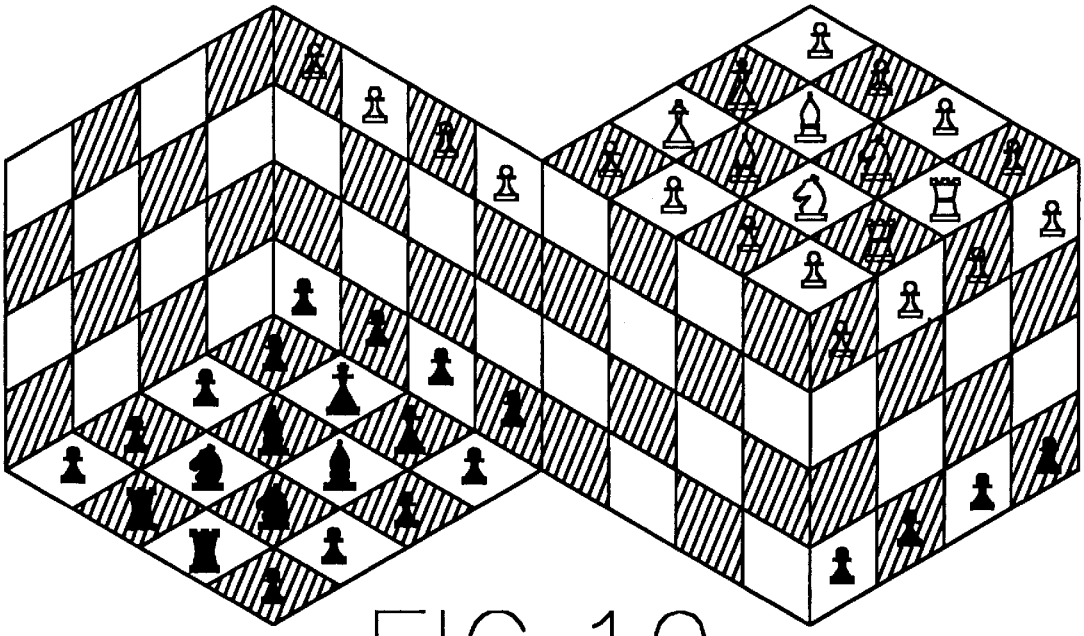
FIG. 19 depicts a plan view of the flat, chessboard layout illustrated in FIG. 18, one with game pieces disposed thereupon.
Figure 20:
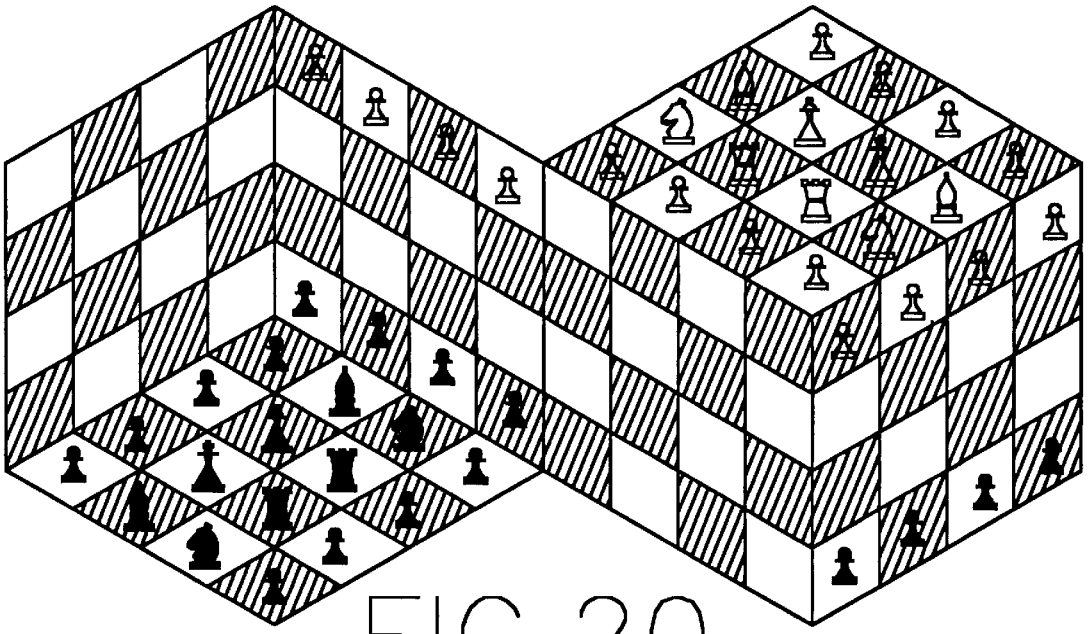
FIG. 20 shows an alternative embodiment of the plan view of the chessboard and games pieces illustrated in FIG. 19.
Figure 21:
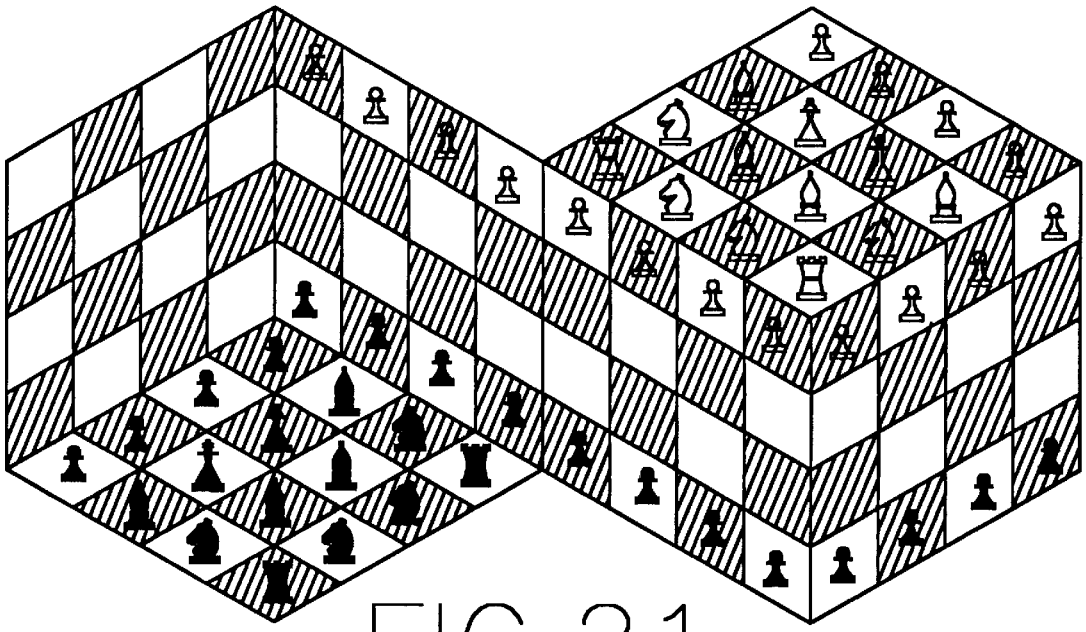
FIG. 21 illustrates a second, alternative embodiment of the plan view of the chessboard and game pieces shown in FIG. 19, one that features a chess set of pieces having two additional bishops and two additional knights.
Figure 22:
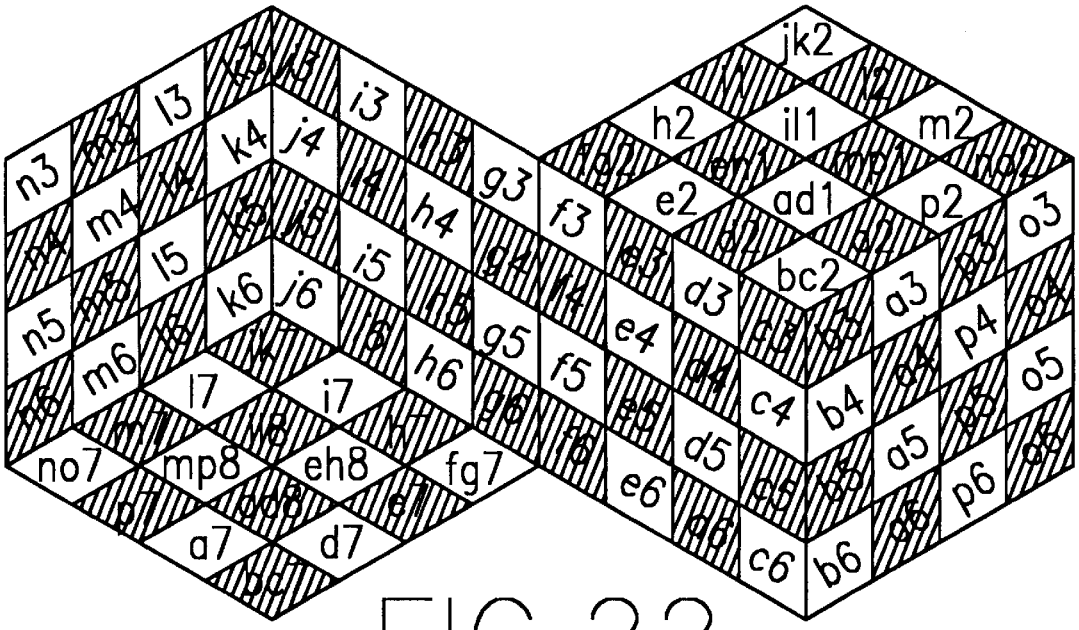
FIG. 22 depicts a second, alternative embodiment of the plan view of the chessboard shown in FIG. 18, one that features identification of the squares for use in algebraic notation.

FIGS. 19, 20 and 21 show three possible arrangements of chess pieces and pawns at the beginning of a chess game.

With regard to the remaining FIGURES in particular (FIGS. 22–29), hereinafter described are facets of a prototypical chess game of the current invention, including the games's rules, objective, moves, game pieces, notation, etc.

The game pieces and pawns are identical to those used in conventional chess, viz., king, queen, bishops, knights, rooks and pawns.

The objective of the game is to capture the opponent's king. The king is not actually captured, but the game ends when it is determined that the king has no escape.

The game is designed for two players. While these rules apply to the particular case of the aforesaid 4-square by 4-square by 4-square cube, and for the starting position shown in FIG. 19, the rules are similar for other cubical face patterns. The cube has four parallel edges, with squares of the same color on each side of the edge; these edges are called "even edges". The cube has two opposite faces that do not include even edges; these are the two starting- position faces. Each face is called the "starting face". The columns of squares parallel to the even edges (but not adjacent an even edge on each face) are designated "long files". They extend toward the center of the starting faces. All long files start at the center of one starting face and end at the center of the other starting face. The columns of squares next to the even edges and parallel thereto extend to the adjacent corners of the starting faces. Shorter in length, these files are designated "short files".

The four squares in the center of the starting face form a "rank". The rank in the center of the upper starting face is termed "rank number one" in accordance with the algebraic notation. Another rank is formed by all of the twelve exterior squares in the upper starting face. This rank is designated "rank number two". The squares found on the subsequent cube faces (moving from the upper starting face toward the opponent's field) form another rank termed "rank number three". Rank number three has 16 squares and circumscribes the cube. The next ranks 4, 5, 6 and 7, respectively, are found upon the lower starting face. There are eight ranks in all. The rank in the center of the lower starting face is "rank number eight".

An algebraic notation has been developed that is similar to the algebraic notation for conventional chess. Now referring to FIG. 22, the identification of the ranks (from 1 to 8) and the identification of the 16 files (from "a" to "p") is depicted. This identification is for the game begun with the game piece distribution shown in FIG. 19. File "a" is the file where the rook of the white queen is located; file "p" is the location of the rook of the white king. Similar algebraic notation for square identification can be developed for those chess games begun with the game-piece distributions shown in FIGS. 20 and 21, respectively.

The preferred starting position is shown in FIG. 19. FIGS. 20 and 21 respectively illustrate optional starting positions. The opposing kings and queens begin in locations opposite each other. The cube is supported in such a way that one starting face is located on the upper half of the cube, and the other starting face on the lower half thereof. A simple way to find the starting face is to first determine the location of the even edges.

The light-colored pieces are located on the upper starting face, which has four squares in the center. The vertical squares are light, and the horizontal squares black. It is easy to remember the entire layout plan by observing that a bishop goes in the upper square, and a knight in the lower square. The other bishop goes to the left, while the other knight goes to the right. The queen and the king start next to each other and next to the bishops. At the starting position, the queen always occupies a square of its own color. The rooks are located next to each other, and adjacent the knights. The squares left empty in the starting face are filled with pawns. A fence of pawns is built along the edge of the king and the queen, as well as along the edge of the rooks. The fence of pawns must protect the pieces in all directions. The black pieces and pawns are located in corresponding, opposite positions.

The light-colored pieces always move first. The players take turns, moving one piece or pawn at a time. A player is allowed to rotate the chessboard only after the opponent's move is complete and before completing his or her own move. A move is complete when a player's hand releases a chess piece in a new position. The player may leave the chessboard in any rotational position at the end of the move. The only exception hereto is the move called "castling", which will be explained hereinafter with reference to FIG. 29.

Figure 23:
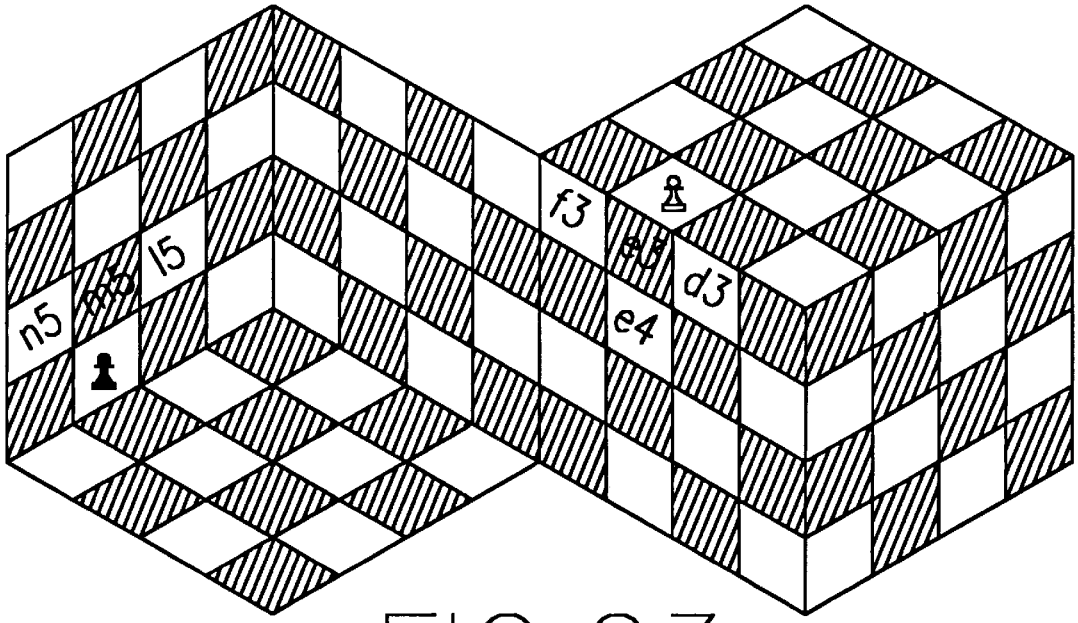
FIG. 23 shows a plan view of the flat, chessboard layout illustrated in FIG. 18, with two pawn game pieces disposed thereupon, along with their possible moves.

FIG. 23 shows the possible moves of the pawn. For simplicity of demonstration, only one pawn of each color is left on the board, as shown. The forward direction is defined as the movement from the edge of the starting face toward the opponent's field. The pawn moves forward, toward the opponent's field, one square at a time. Pawns in the corner of the starting face move along either side of the even edge toward the opponent's field. The only exception is a pawn's first move, which begins from the starting face. These pawns may move one or two spaces forward on the first move (e.g., to e3 or e4 for the white pawn, or to m5 for the black pawn). All pawns capture diagonally, and take a position where the capture occurs with one move (e.g., f3 or d3 for the white pawn, and n5 or 15 for the black pawn). A hostile pawn can still capture a home pawn in a following move, if the home pawn moves two spaces forward, but it could have been captured if it had moved only one space. The hostile pawn takes the position as if the moving pawn had moved only one space. This move is called capturing "en passant". A pawn may be promoted to any piece of the same color that its player chooses (except the king), when it reaches one of the four squares in the center of the opposite starting face.

All of the pawns moving along the even edges stall when they reach the opposite starting face (i.e., the spaces in the corners). These pawns will be able to move to the promotion squares only by capturing. Pawns cannot move backwards.

Referring now to FIGS. 24 to 28, the possible new locations that each piece can take in one move are illustrated. For simplicity, only one piece is left on the board.

Figure 24:
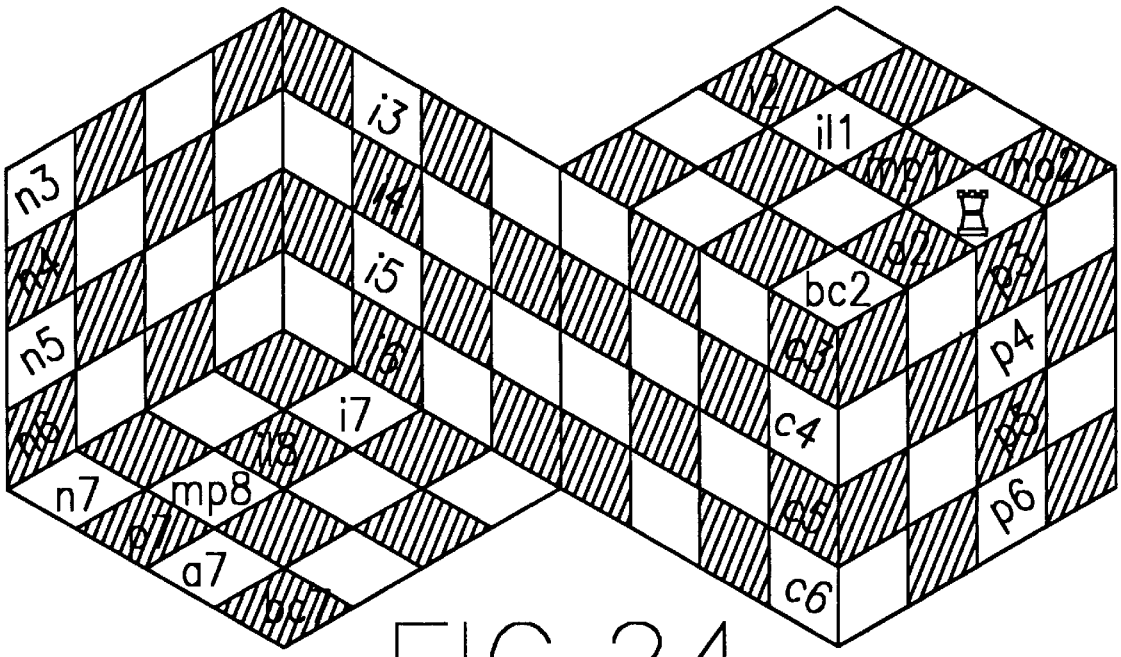
FIG. 24 illustrates a plan view of the flat, chessboard layout depicted in FIG. 18, with a rook game piece disposed thereupon, along with its possible moves.

FIG. 24 shows the move of the rook. It can take any space, shown with algebraic notation, in one move, provided that there is no piece or pawn of the same color in the way. The rook may capture an opponent's pawn and take its position, or may stop in a space before, if there is one piece or pawn of the opponent in the way. The rook cannot jump over pieces or pawns of any color. It can move forward, backward or to either side. The motion of the rook follows the direction parallel to the edges of the cube, and it can reach all of the way around the cube.

Figure 25:
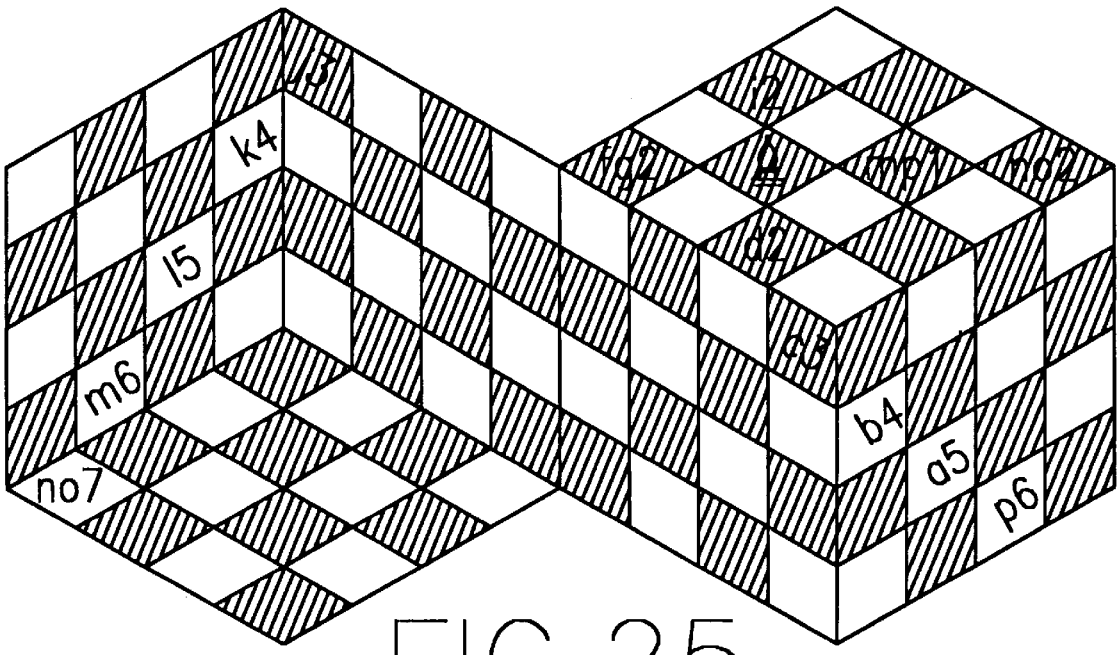
FIG. 25 depicts a plan view of the flat, chessboard layout shown in FIG. 18, with a bishop game piece disposed thereupon, along with its possible moves.

FIG. 25 shows the move of the bishop. It can take any space in one move, shown with algebraic notation, provided that there is no piece or pawn of the same color in the way. The bishop may capture a pawn and take that position, or may stop in a space before, if there is one piece or pawn of the opponent in the way. The bishop cannot jump over pieces or pawns of any color. It can move forward or backward. The bishop moves in a diagonal direction, and it can reach all of the way around the cube. The color of the space that the bishop occupies changes every time that the bishop crosses an even edge.

Figure 26:
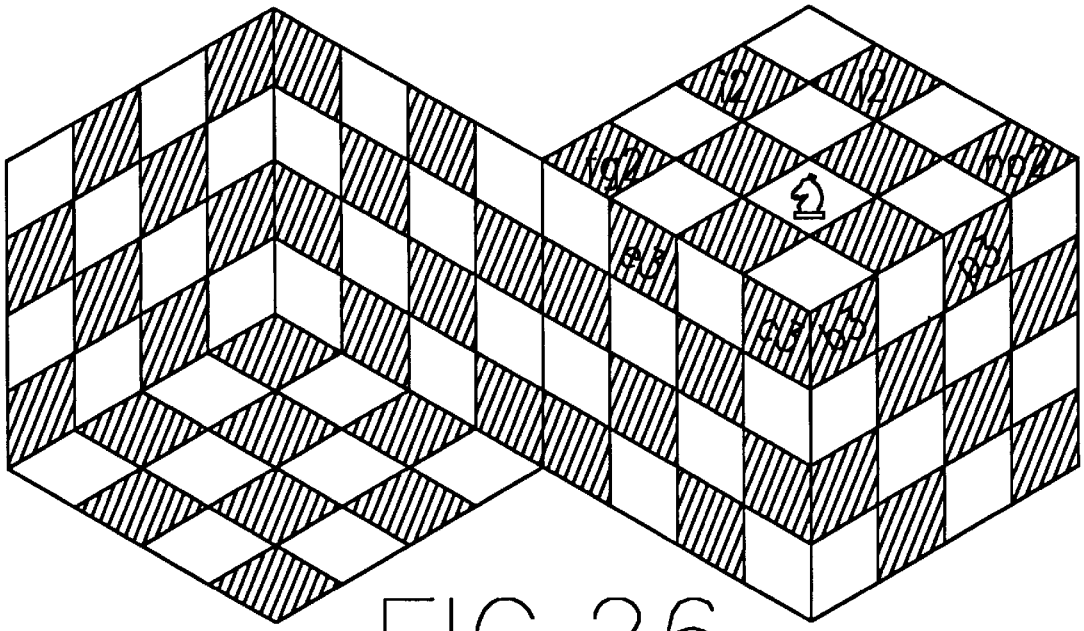
FIG. 26 shows a plan view of the flat, chessboard layout depicted in FIG. 18, with a knight game piece disposed thereupon, along with its possible moves.

FIG. 26 depicts the move of the knight. It can take any space in one move, shown with algebraic notation. The knight may capture an opponent's piece and take that position. It can jump over pieces or pawns of any color, if there is one piece or pawn of the opponent's in the square. The knight can move forward or backward. The motion of the knight follows the conventional "L" pattern: one square forward or to the side; and one diagonal space, etc. The knight can cross only one edge of the cube in each move.

Figure 27:
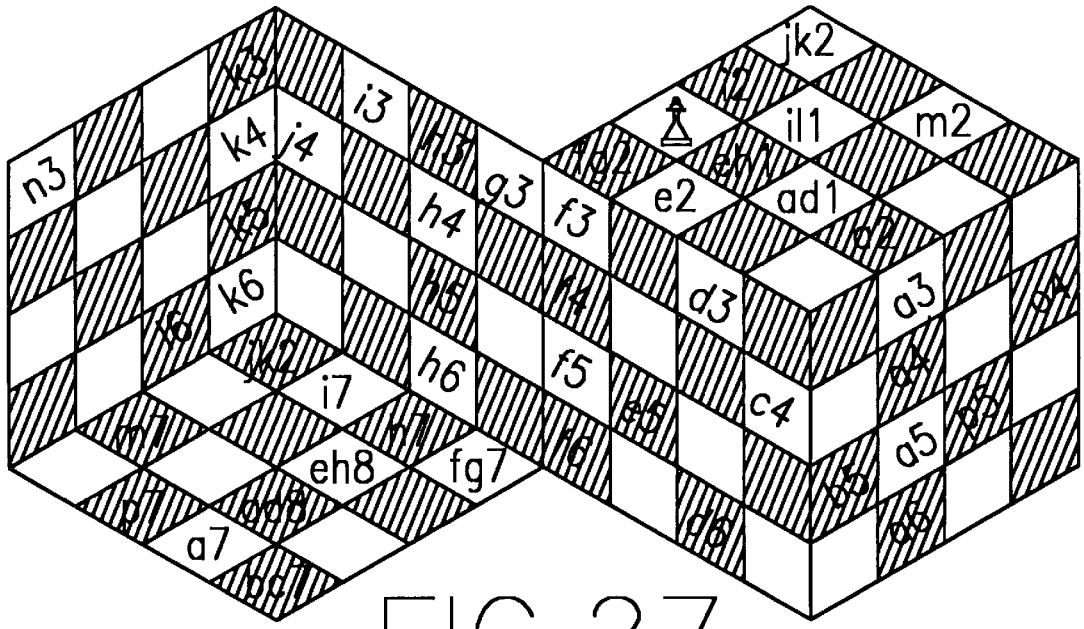
FIG. 27 illustrates a plan view of the flat, chessboard layout shown in FIG. 18, with a queen game piece disposed thereupon, along with its possible moves.

Referring now to FIG. 27, the move of the queen is illustrated. The queen can take any space in one move, shown with algebraic notation, provided that there is no piece or pawn of the same color in the way. The queen may capture an opponent's piece and take that position, or she may stop in a space before, if there is one piece or pawn of the opponent in the way. The queen cannot jump over pieces or pawns of any color. It can move forward or backward, similar to the movement of a rook or that of a bishop. The queen can reach all of the way around the cube.

Figure 28:
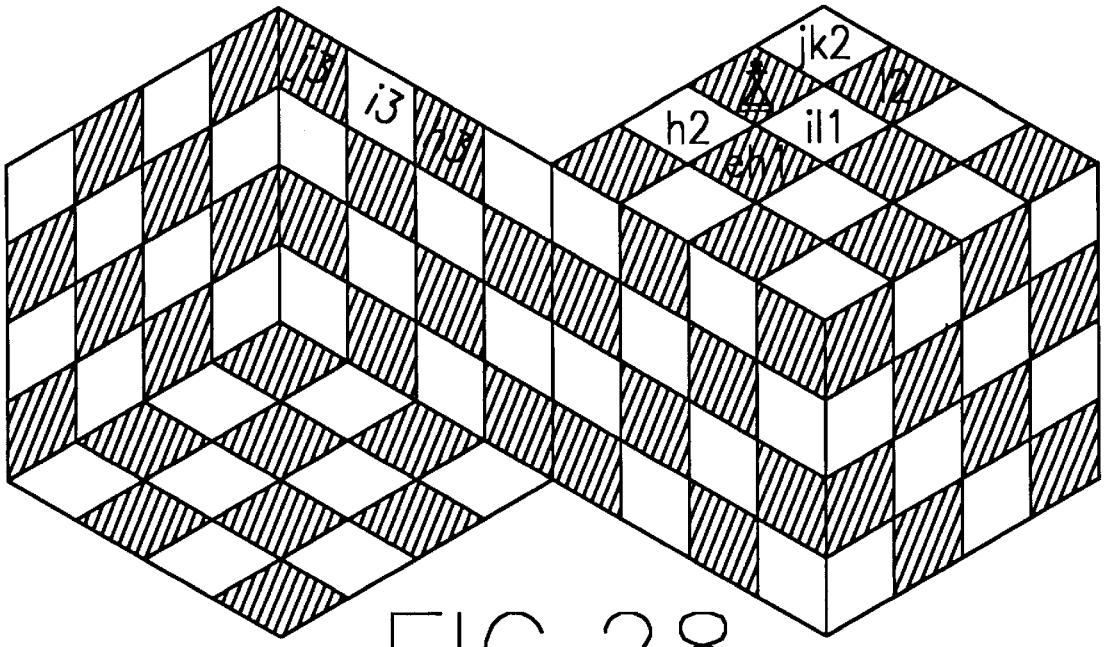
FIG. 28 depicts a plan view of the flat, chessboard layout shown in FIG. 18, with a king game piece disposed thereupon, along with its possible moves.

FIG. 28 depicts the move of the king. It can take any space, shown with algebraic notation. The king may capture an opponent's piece and take that position. It cannot jump over pieces or pawns of any color. The king can move forward or backward, similar to the movement of a rook, or that of a bishop, but it can move only one space at a time.

Figure 29:
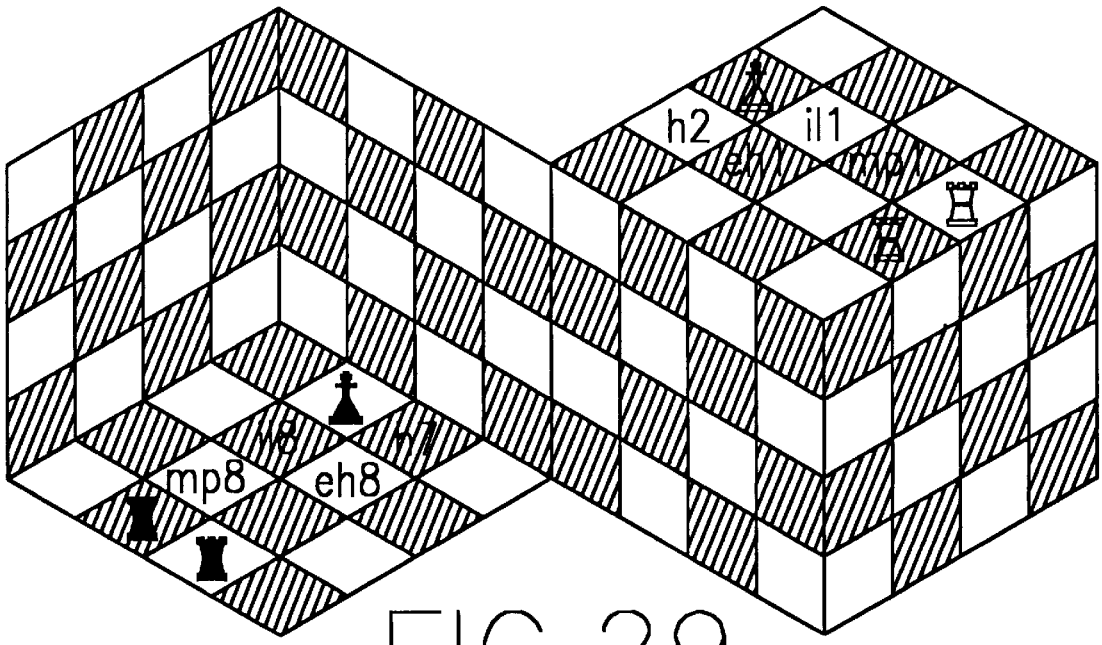
FIG. 29 depicts a plan view of the flat, chessboard layout shown in FIG. 18, depicting the castling move disposed thereupon.

Referring now to FIG. 29, the castling move for both white and black pieces is shown. Castling is the only move in which a player can move two pieces simultaneously, namely, the king and one rook. Each player may make this move only once during a game. To have the privilege of castling, it is necessary that all of the squares between the king and one of the rooks in the starting position be empty, and that neither piece has been previously moved. The king is not allowed to castle out of "check" (see below), through check or into a check. Castling is sometimes important, in order to place the king in a safer position. In cubical chess, however, the field has no borders, which provide sanctuary in regular chess. Therefore, the protection for the king at the new location requires additional preparation with other, protecting pieces.

The white king side castling move is made by moving the king to mp1, with the rook lined up with the king to il1. The queen side castling move is made by moving the king to eh1, with the rook lined up with the queen's starting location, (h2) to h2. Similarly, in the case of the black pieces, the castled king finally resides in either mp8 or in eh8, and the respective rook finally resides in either il8 or in h7.

A king is under "check" when it is attacked by an opponent's piece or pawn. It is mandatory to remove this threat to the king immediately. A "checkmate" occurs, and the side that is checkmated loses, if the positions of the pieces and pawns are such that an opponent's threat cannot be eliminated in one move.

The king must not move to a location where it will be in check. A player must move the king back to an original position and make a different move, if the player overlooks the check. A checked king must be defended immediately, as aforementioned. Should a player overlook the threat and make a different move, the player is required to cancel the original move and make a move that protects the king.

A "stalemate" occurs, and the game is considered a "draw", when one player's king is not checked, but it is not possible for the king to move without putting him in check. In this case, neither player wins. When a player can incessantly check the opponent's king by a repetition of a series of moves, the position is also considered a draw. A draw can occur when fifty moves have been made without accomplishing a checkmate; no piece or pawn has been captured; or no pawn has moved. An exception to the last rule occurs when it can be shown that a mate would require more than fifty moves.

The chessboards described herein can be part of a computer program, such as the AutoCad™ program, that is capable of representing data as three-dimensional images and vice versa. The data can be stored, manipulated, and displayed graphically on display monitors. The images of manipulable game pieces, to be disposed on the exterior surface of the cube, may be electronically moved, added and deleted by appropriate commands. Two-dimensional chess games have been the subject of computer programs for over 25 years, making it relatively simple for programmers skilled in the art to extend concepts and principles to three dimensions in accordance with the present invention. Computer languages such as C, C++, and PASCAL are commonly employed for this purpose.

The chessboards can also be a part of a fabricated article selected from a group consisting of paperweights, trophies, book-ends, lunch boxes, lighting fixtures, lamps, trinket boxes, jewelry boxes, radio shells, telephone shells, clock shells, ashtrays, serving bowls, storage containers, table bases and wastebaskets, etc.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A cubical, three-dimensional chessboard assembly comprising a rotatable cube with respective cube faces, each of said respective cube faces having a board pattern disposed thereon, and each of said respective cube faces consisting of a 4×4 pattern of adjacent shapes to complete a three-dimensional, rotatable, borderless chess game board.

2. The three-dimensional chessboard assembly in accordance with claim 1, wherein said adjacent shapes comprise squares.

3. The three-dimensional chessboard assembly in accordance with claim 1, wherein said adjacent shapes comprise rectangles.

4. The three-dimensional chessboard assembly in accordance with claim 1, wherein said cubical chessboard assembly is substantially hollow.

5. The three-dimensional chessboard assembly in accordance with claim 4, wherein at least one of said respective cube faces may be displaced from the remaining respective cube faces.

* * * * *